US007013868B2

(12) United States Patent
Muertter

(10) Patent No.: US 7,013,868 B2
(45) Date of Patent: Mar. 21, 2006

(54) ACCELERATOR SIGNAL OFFSET SYSTEM

(76) Inventor: Robert E. Muertter, 28202 Coulter, Mission Viejo, CA (US) 92692

( * ) Notice: Subject to any disclaimer, the term of this patent is extended or adjusted under 35 U.S.C. 154(b) by 83 days.

(21) Appl. No.: 10/784,073

(22) Filed: Feb. 20, 2004

(65) Prior Publication Data

US 2005/0183694 A1 Aug. 25, 2005

(51) Int. Cl.
*F02D 41/16* (2006.01)
*F02D 11/10* (2006.01)

(52) U.S. Cl. ..... 123/339.14; 123/339.1; 123/399

(58) Field of Classification Search ..... 123/339.1, 123/339.14, 357, 361, 399, 494; 74/513, 74/514; 73/116, 118.1
See application file for complete search history.

(56) References Cited

U.S. PATENT DOCUMENTS

| | | | | |
|---|---|---|---|---|
| 2,539,791 A | | 1/1951 | Mozzaninini et al. | 318/92 |
| 3,075,029 A | | 1/1963 | Michaud | 123/624 |
| 3,255,425 A | | 6/1966 | Witt et al. | 333/81 |
| 3,747,580 A | * | 7/1973 | Savage | 123/364 |
| 3,757,574 A | | 9/1973 | Plankinton | 73/150 A |
| 4,242,994 A | * | 1/1981 | Keely | 123/339.23 |
| 4,527,112 A | | 7/1985 | Herman | 322/38 |
| 4,915,075 A | * | 4/1990 | Brown | 123/399 |
| 5,035,216 A | * | 7/1991 | Sakamoto et al. | 123/339.13 |
| 5,090,380 A | * | 2/1992 | Suzuki et al. | 123/339.13 |
| 5,528,500 A | | 6/1996 | Al-Charif et al. | 701/99 |
| 5,534,760 A | | 7/1996 | Jung | 318/442 |
| 6,274,944 B1 | | 8/2001 | Letang | 290/40 R |
| 6,488,005 B1 | | 12/2002 | Kim | 123/339.16 |
| 6,573,614 B1 | | 6/2003 | Doll | 290/40 C |
| 6,868,328 B1 | * | 3/2005 | Fulton | 701/104 |
| 2002/0134349 A1 | | 9/2002 | Pursifull | 123/339.19 |
| 2002/0152989 A1 | | 10/2002 | Price | 123/339.21 |
| 2003/0024504 A1 | | 2/2003 | Bauerle | 123/396 |
| 2003/0111046 A1 | | 6/2003 | Han | 123/399 |

OTHER PUBLICATIONS

"Automotive technical Topics—Electronic Throttle Control," web page printed Feb. 2004 from http://www.autosolve.com/etc.htm.
"Electronic Engine Control-Model 2001," Glendinning Marine Products Brochure, dated 2001.
"High Idle Devices", web page printed Feb. 2004 from http://www.penntexusa.com/idle.htm.
"Information on BMW idle speed problems," web page printed Feb. 2004 from http://www.unofficialbmw.com/repair_faqs/idle.html.

(Continued)

*Primary Examiner*—Tony M. Argenbright
(74) *Attorney, Agent, or Firm*—Edwin A. Suominen; Louis J. Hoffman

(57) ABSTRACT

A disclosed accelerator pedal offset system includes a first connector that can be coupled to an accelerator pedal of a motor vehicle and a second connector that can be coupled, in place of the accelerator pedal, to an engine control module of the vehicle. The second connector is coupled to the first connector via a plurality of electrical conductors. The system further includes a resistor selectably connected across a first pair of the electrical conductors. The selectable connection is implemented with an electrically activated switch that connects between each resistor and its respective pair of electrical conductors. In such a configuration, the resistor can be connected across its pair of electrical conductors to apply an accelerator signal offset, and disconnected to remove the offset. Variations and methods are also disclosed.

20 Claims, 4 Drawing Sheets

OTHER PUBLICATIONS

"Introducing from VMAC a new Ford 6.0L Diesel Throttle Control," web page printed Feb. 2004 from http://www.v-mac.ca/throttle/new_products.htm.

"Rheostat range limiting," web page printed Feb. 2002 from http://www.allaboutcircuits.com/vol_6/chpt_3/9.html.

"Throttle Commander," web page printed Feb. 2004 from http://www.vmac.ca/throttle/index.htm.

"Wiring 3rd Party Pedals to the LWFF Wheel Unit," web page printed Feb. 2004 from http://users.pandora.be/jan..verschueren./LWFFmod/pedalmod.htm.

Undated Throttle Commander brochure printed Feb. 2004 as image from http://store.zips.com/catimg.asp?catimg=TCBrochure.jpg.

* cited by examiner

ACCELERATOR SIGNAL OFFSET SYSTEM

BACKGROUND OF THE INVENTION

High idle controllers are conventionally employed to increase the rotational speed at which a vehicle's engine idles and thus increase the energy output of the vehicle's charging system. Such an increase can be useful to maintain battery charge in the face of unusually high current demands. As pointed out in U.S. Pat. No. 6,573,614 to Doll, for example, police vehicles often have numerous specialized electrical and electronic systems that can place a heavy energy demand on the vehicle alternator when the vehicle is parked, as at an accident scene, running at idle speed for a long period of time.

Traditionally, a motor vehicle's engine throttle is controlled via mechanical linkage to an accelerator pedal. Known systems for increasing idle speed in such vehicles include that disclosed in U.S. Pat. No. 4,527,112 to Herman, in which an electrically controllable mechanical device holds an engine throttle control somewhat more open than its normal idle position.

Motor vehicles of more recent manufacture use a "drive-by wire" system in which the accelerator pedal mechanically connects to one or more potentiometers, which provide electrical input to an electronic control module that in turn controls the engine's throttle with some electromechanical structure. The Doll patent discloses an electronic device for controlling the idle speed of such a vehicle's engine to maintain a high output voltage level of the vehicle's engine-driven alternator. The device takes over control of the idle speed of the engine from a conventional electronic control module. Instead of the electronic control module operating an engine idle speed control device such as a valve or other type of throttle, Doll's disclosed electronic device performs that function, responsive to output signals (intended for such operation) from the electronic control module.

Another known approach, employed in the "Throttle Commander" product manufactured by VMAC, is to plug a device directly into the accelerator pedal.

SUMMARY OF THE INVENTION

An accelerator pedal offset system according to various aspects of the present invention includes a first connector that can be coupled to an accelerator pedal of a motor vehicle and a second connector that can be coupled, in place of the output from the accelerator pedal, to an engine control module of the vehicle. The second connector is coupled to the first connector via a plurality of electrical conductors. The system further includes a resistance (i.e., a single resistor or combination of resistors) selectably connected across a first pair of electrical conductors. The selectable connection is implemented with an electrically activated switch that connects between each resistor and its respective pair of electrical conductors. In such a configuration, the resistor can be connected across its pair of electrical conductors to apply an accelerator signal offset and disconnected to remove the offset.

The parallel resistance circuitry can further include a plurality of additional resistors that are selectably connected in parallel with the first one across a given pair of electrical conductors. In that configuration, the resistance connected across the conductor pair is easily selectable.

The above summary does not include an exhaustive list of all aspects of the present invention. Indeed, the inventor contemplates that the invention includes all systems and methods that can be practiced from all suitable combinations of the various aspects summarized above, as well as those disclosed in the detailed description below and particularly pointed out in the claims filed with the application. Such combinations have particular advantages not specifically recited in the above summary.

DESCRIPTION OF PREFERRED EXEMPLARY EMBODIMENTS

Figure 1:
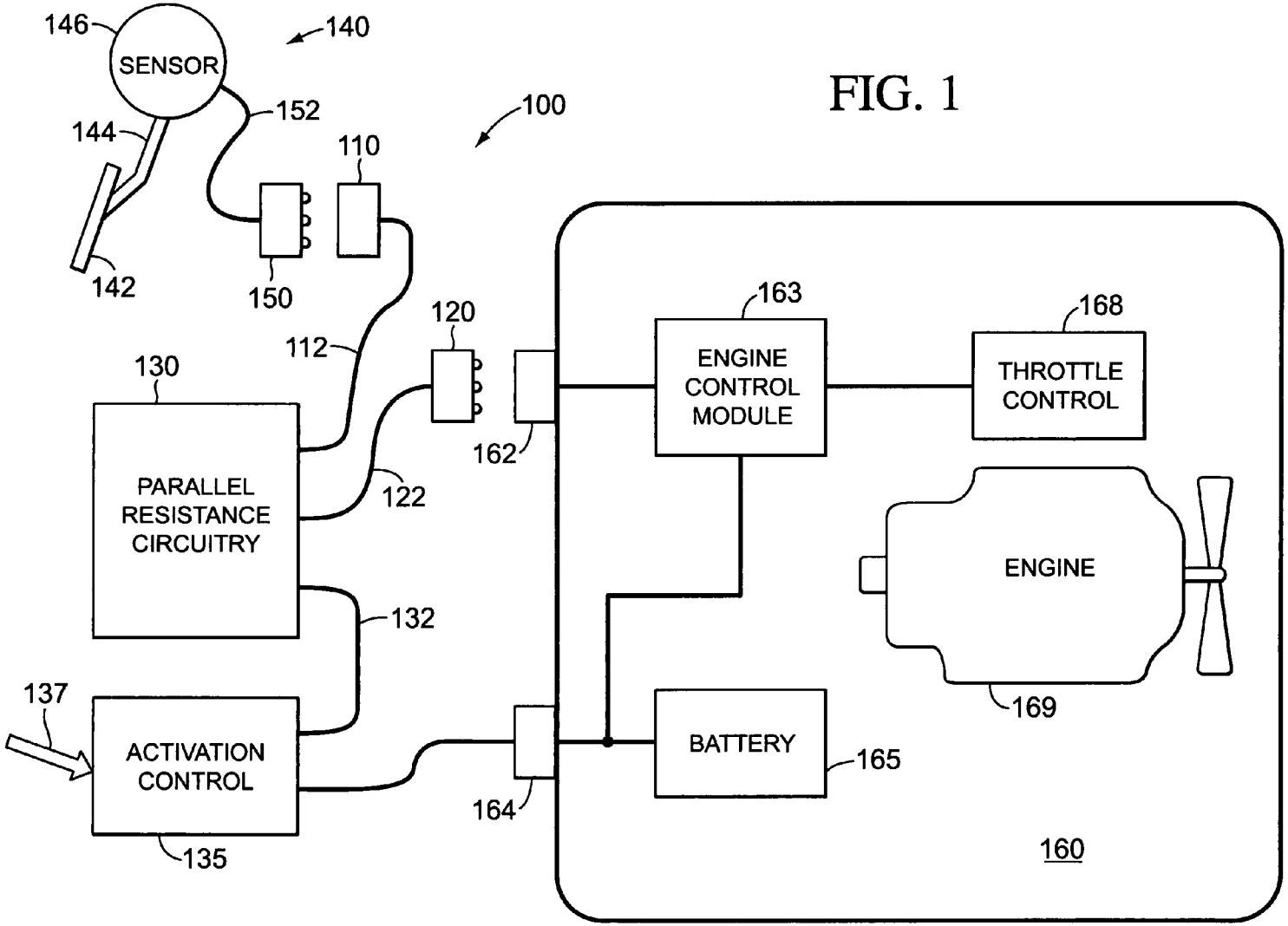
FIG. 1 is a schematic block diagram of an accelerator signal offset system according to various aspects of the present invention connected in a motor vehicle.

An accelerator signal offset system according to various aspects of the present invention provides numerous benefits, including simple, efficient, and surprisingly effective idle increase in a "drive-by-wire" vehicle. Exemplary system 100 of FIG. 1 includes a female connector 110 connected by a cable 112 to parallel resistance circuitry 130, which connects via another cable 122 to a male connector 120.

System 100 is installed between an accelerator pedal assembly 140 and a connector 162 of an engine control module 163. Accelerator pedal assembly 140 includes an accelerator pedal 142 connected via mechanical linkage 144 to a variable-resistance (i.e., potentiometer) sensor 146 and (via cable 152) to a male connector 150 intended to make direct electrical connection to connector 162. When installed between assembly 140 and connector 162 with its parallel resistance circuitry 130, system 100 changes the apparent setting of sensor 146 as perceived by engine control module 163.

Engine control module 163 operates a throttle control structure 168 inside an engine compartment 160 of the vehicle (schematically shown, in part) in which system 100 is installed. Control module 163 typically includes one or more microcontrollers that monitor inputs such as the position of sensor 146 and set outputs such as an electrical signal that operates throttle control structure 168, which includes electromechanical structure suitable for varying fuel consumption of an engine 169. Control module is powered by a battery 165 which is charged by alternator and voltage regulator system (not shown) powered by engine 169.

"Drive-by-wire" vehicles presently use two or three potentiometers in their accelerator pedals, requiring the potentiometers to track each other when the accelerator pedal is depressed, although single-potentiometer models are possible. Exemplary sensor 146 of accelerator pedal assembly 140 may better understood with reference to the schematic diagram of FIG. 2. Sensor 146 includes three potentiometers 210, 220, 230 with wipers 212, 222, 232, respectively, actuated by a common linkage 144 (FIG. 1). A 10-pin connector 150 connects to potentiometers 210, 220, 230. In the vehicles listed in TABLE I below, connector 150 appears with a male body and two rows of five female pin receptacles labeled A–K, with the letter "I" skipped. Numbers 1–10 of connector 150 (and also connectors 110, 120 of FIGS. 1, 3) correspond to letters A–H, J, and K of such connectors, in order. Connectors 110, 120 are female and male connectors (referring to the connector body, with opposite gender pins or pin receptacles), respectively, of the two-row type.

Figure 2:
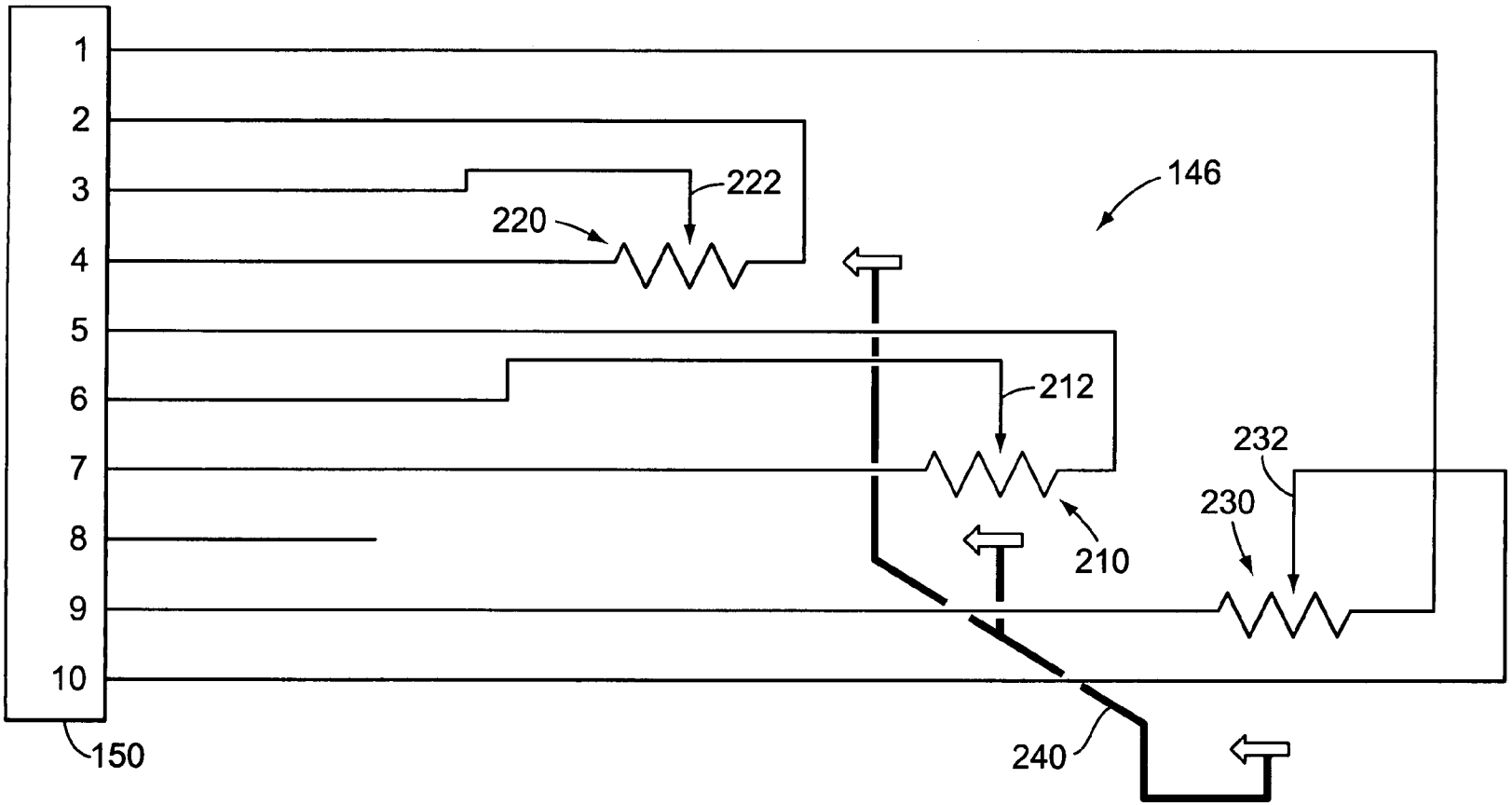
FIG. 2 is a schematic diagram of an accelerator pedal sensor in the motor vehicle of FIG. 1.

FIG. 2 schematically depicts linkage 144 with ganged arrows 240. The further pedal 142 (FIG. 1) is depressed, the closer wipers 212, 222, 232 move toward the left (in FIG. 2) edges of potentiometers 210, 220, 230. Thus, the resistance across pairs of pins 3–4, 6–7, and 9–10 decreases with increased accelerator pedal actuation. When activated, parallel resistance circuitry 130 (FIG. 1) connects across those pins to decrease the resistance across them and simulate such an increase in pedal actuation. Advantageously, simple passive resistors of circuitry 130, with carefully selected resistance values, can increase idle speed of engine 169 to a desired high idle level, e.g., 1250 RPM.

Figure 3:
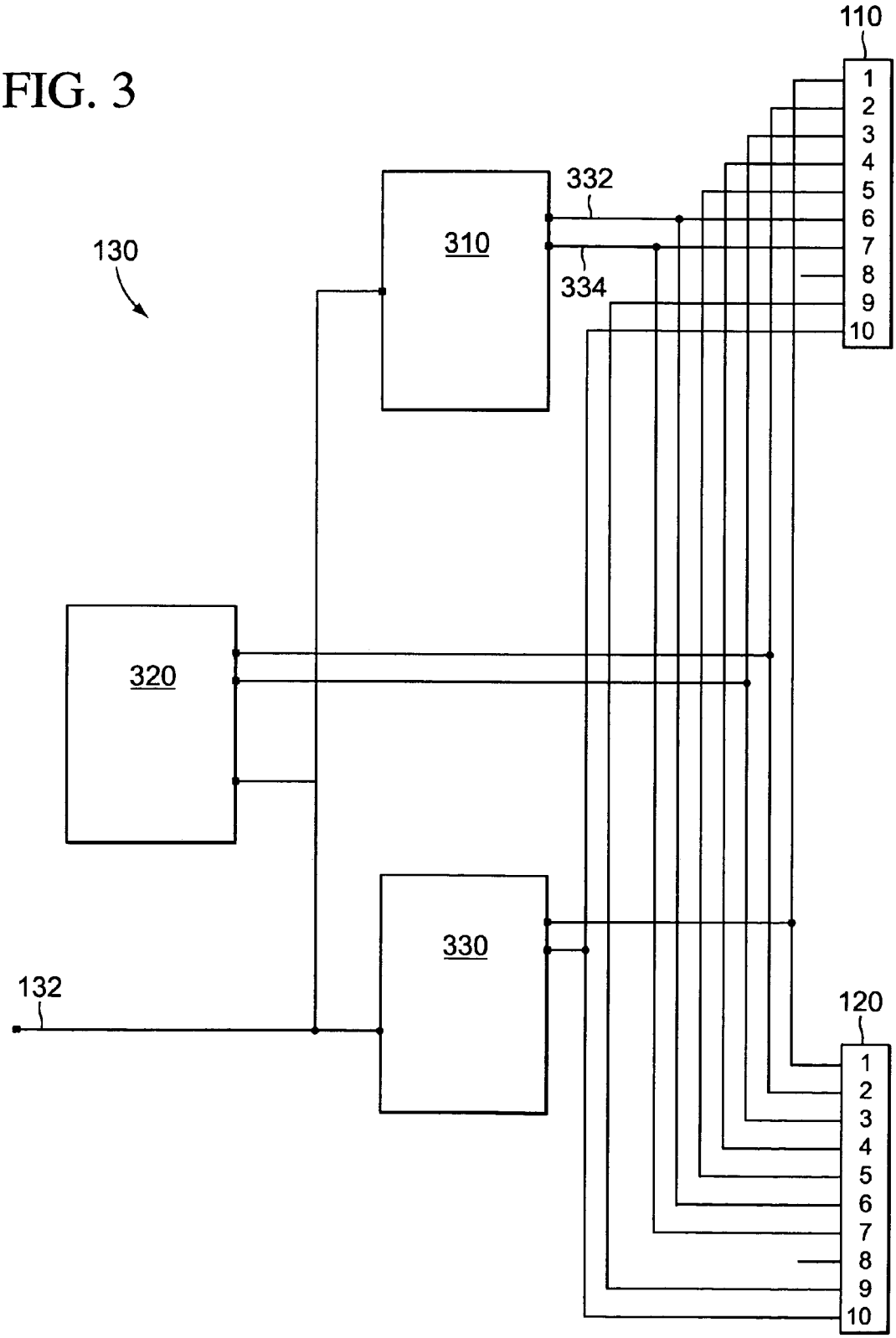
FIG. 3 is a schematic block diagram of exemplary parallel resistance circuitry for use in the system of FIG. 1.

Parallel resistance circuitry 130 may be better understood with reference to the schematic block diagram of FIG. 3. Pins 1–7, 9–10 of connector 110 are coupled to corresponding pins of connector 120 via a plurality of electrical conductors. In system 100, the conductors are bundled wires of cables 112, 122 (FIG. 1) and traces of a printed circuit board (not shown) forming a substrate for circuitry 130. Switchable parallel resistance subcircuits 310, 320, 330 connect across pairs of pins 3–4, 6–7, and 9–10 when activated at line 132. (The source of such activation can include a logical combination of user input, transmission park status, and brake pedal activation status, as discussed below.) The parallel resistance causes an apparent shift leftward (in the schematic view of FIG. 2) of potentiometers in pedal sensor 146 and a consequent increase in rotational speed of engine 169.

To avoid confusing engine control module 163 with diverging potentiometer readings (e.g., more than 10%) and having it activate a "check engine" light or otherwise enter a fault condition, the resistance values of subcircuits 310, 320, 330 are carefully selected. TABLE I below lists exemplary values for various vehicles. Entries with a dash in the column for subcircuit 330 are for vehicles using just two sensors in their accelerator pedals, for which only subcircuits 310, 320 are employed with no third parallel resistance subcircuit. Preferred precision of all resistance values is at least 1%.

TABLE I

| Model | Year(s) | Engine | 310 | 320 | 330 |
|---|---|---|---|---|---|
| 3500 HD | 2001–2002 | 8.1 Liter Gas | 61.9K | 38.3K | 116.5K |
| Tahoe, Yukon, Suburban, 1500 Truck, Escalade | 2001–2003 | 5.3 Liter Gas | 69.8K | 32.4K | 124K |
| Suburban, Escalade, Yukon XL | 2002–2003 | 6.0 Liter Gas | 45.3K | 22.6K | 82.5K |
| H2 Hummer | All | 6.0 Liter Gas | 69.8K | 32.4K | — |
| Tahoe, Yukon, Suburban, Yukon XL | 2004 | 5.3 Liter Gas | 69.8K | 32.4K | — |
| 2500HD, 3500 | 2002–2003 | 6.0 Liter Gas | 41.6K | 21K | 75K |
| 2500HD, 3500 | 2002–2004 | 8.1 Liter Gas | 49.1K | 23.9K | 87.9K |
| 2500HD, 3500 | 2002–2004 | 6.6 Liter Diesel | 65.1K | 32K | 115K |
| Suburban | 2003 | 8.1 Liter Gas | 65.1K | 32K | 115K |
| Escalade EXT, Avalanche | 2003 | 6.0 Liter Gas | 75K | 34.8K | 133K |
| 2500HD, 3500, Escalade, Suburban, Yukon XL | 2004 | 6.0 Liter Gas | 95.3K | 45.3K | — |

To avoid the need to install a particular set of precision resistors for a specific vehicle, additional resistors can be selectably switched across the parallel connections. In the variation illustrated in FIG. 4, for example, parallel resistance subcircuit 310 includes a base resistor R1 with additional resistors R2–R6 switchable in parallel with it, depending on the desired setting of DIP switch 410. TABLE II lists exemplary values of R1–R6 for such a variation of subcircuits 310, 320 to work with various two-sensor vehicles. The values of R2–R6 are approximately in a doubling sequence to obtain 32 predictably spaced parallel resistance values, from about 40–100 kilohms for subcircuit 310 and from about 20–48 kilohms for subcircuit 320.

TABLE II

| Resistor | 310 | 320 |
|---|---|---|
| R1 | 100K | 48K |
| R2 | 133K | 67K |
| R3 | 270K | 135K |
| R4 | 442K | 220K |
| R5 | 976K | 488K |
| R6 | 2M | 1M |

Figure 4:
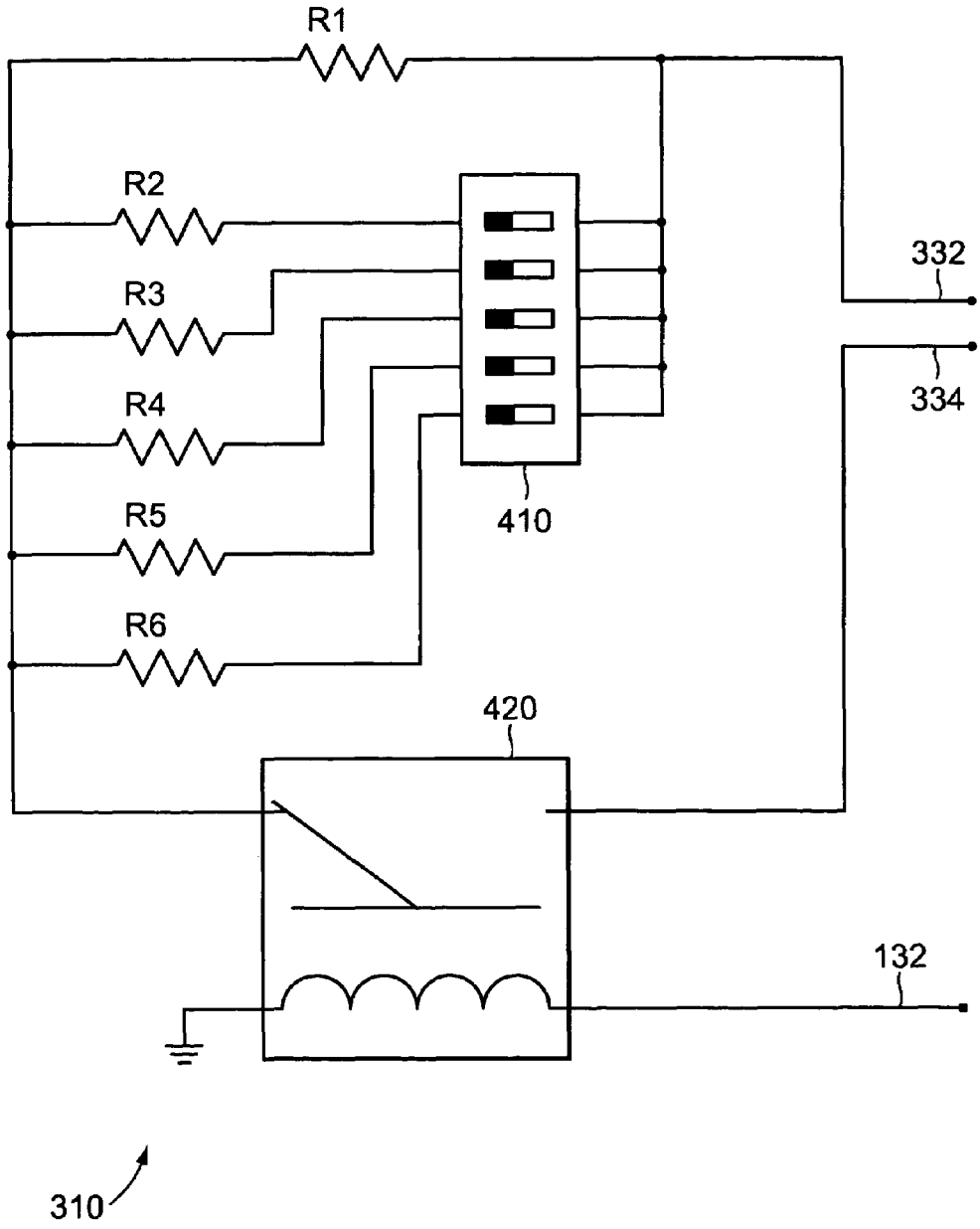
FIG. 4 is a schematic diagram of an exemplary switched-resistor circuit for use in the circuitry of FIG. 3.

As discussed above, the resistances of subcircuits 310, 320, 330 are selectably switchable in parallel with pairs of pins 3–4, 6–7, and 9–10 of connectors 110, 120. By providing such selectable switching, system 100 permits activation of a high idle setting for engine 169 when safe and desirable. An electrically activated switch of any suitable type (e.g., relay, transistor, MOSFET) can be employed to make or break the parallel connection selectably. As illustrated in FIG. 4, for example, parallel resistance subcircuit 310 employs an electromechanical relay 420 (with conventional coil diode not shown) to selectably connect resistor R1 and a desired combination of resistors R2–R6 across lines 332, 334, which connect to pins 6–7 of connectors 110, 120 of FIG. 3. (A three-pole relay can substitute for separate relays in subcircuits 310, 320, 330.)

Offset of the signal from accelerator pedal sensor 146 is considered desirable for high idle when electrical accessories (not shown) are drawing significant amounts of current from battery 165 and its charging system (not shown). However, such offset is not considered desirable for safety and practical reasons unless the vehicle is in "park" (for an automatic transmission) or "neutral" (for a manual transmission). Because electronic control module 163 typically looks at the signal from sensor 146 when engine 169 is starting up and considers the signal level at that point to be the idle signal level, a high idle signal offset is generally also undesirable at that time. In addition, it can be desirable for a user to be able to explicitly disable high idle operation by pressing the vehicle's brake pedal, or to explicitly enable it with an on/off switch.

Activation control subsystem 135 of FIG. 1 asserts an activation signal on line 132 (FIGS. 1, 3–4) when an input condition, schematically represented with arrow 137, meets predetermined criteria indicating that an accelerator signal offset and consequent high idle are desirable. Subsystem 135 can monitor the voltage at battery 165, via its power connection at connector 164, and assert the activation signal when the voltage drops below 12.6 volts for more than 10 seconds. In addition or alternatively, subsystem 135 can connect to a "stoplight brake switch" line provided on many vehicles (e.g., with a green, white-striped wire) and asserts the activation signal only if the vehicle is in "park" without the brake pedal depressed. To assert the activation signal only if the vehicle is in "park" without regard to the state of the brake pedal, subsystem 135 can connect to a "park interlock" line (e.g., with a green, black-striped wire). For manual activation, alone or in suitable combination with the above activation options, activation control subsystem 135 can monitor the state of the "high idle" switch and force activation even if the voltage at battery 165 would not otherwise trigger activation, or if one of the other conditions is not met. Generally, however, activation should not be permitted, even when manually requested, unless the vehicle is in "park" or "neutral," depending on transmission type, and the engine is not being started.

Inputs can be combined to determine whether or not activation is appropriate with a simple parallel connection to 12 volt DC sources (logical "or"), a switchable connection to a park interlock signal via a relay that can be deactivated by signal indicating that activation is inappropriate (logical "and"), or with any other suitable technique, e.g., digital logic or microprocessor control.

Activation control subsystem 135, which can be separate from or integral with parallel resistance circuitry 130, asserts the activation signal on line 132 with whatever type of driver circuitry is suitable for operating an electrically activated switch or switches of circuitry 130. For example, subsystem 135 can include a conventional NPN transistor sinking 12 volt DC to ground through a coil of relay 420 (FIG. 4) with its base driven at the center tap of a voltage divider connected to the appropriate interlock signal and made up of two 10-kilohm resistors. A fuse can be employed in series with the relay coil.

Components of system 100 can be packaged in any suitable manner. For example, parallel resistance circuitry 130 and activation control subsystem 135 can be implemented on a common printed circuit board packaged inside a compact plastic potting box, which can be conveniently mounted with double-sided tape to the rubber mat material commonly found in the cab of motor vehicles. In a variation, the enclosure includes one or more flanges for screw or both attachment. Connectors 110, 120 can attach to the enclosure via 5–7 inch long cables. Appropriate strain relief can be provided.

During installation, the wire for activation (i.e., power) line 132 and a ground wire (not shown) to the enclosure should be kept away from connectors 110, 120 and their cables 112, 122 to avoid interference with the accelerator pedal signal. A good quality ground is preferred. An "add a circuit" fuse adapter can be employed to tap into the vehicle's fuse panel for the connections.

Selection of parallel resistance values to effect a given increase in idle speed can be performed by any suitable technique. For example, to increase idle speed to 1250 RPM without activation of the accelerator pedal, the voltage across pins 3–4, across pins 6–7, and across pins 9–10 of connector 150 of accelerator pedal sensor 146 (FIG. 2) can be observed at different engine speeds, iteratively or following a predetermined measurement interval. The measurements are preferably at speeds including speeds around the desired (in this example) 1250 RPM mark. (In variations suitable for connection to accelerator pedal sensors with fewer than three potentiometers, observations are made of correspondingly fewer potentiometer voltages.) The parallel resistance across across the potentiometer pins is selected to reduce the potentiometer resistances, with no accelerator pedal depression, to the levels encountered at the desired engine speed while maintaining correspondence between the accelerator pedal resistances across the range of pedal travel. The resistances can be computed, e.g., from observed voltages across pins 6–7, 9–10, etc. and potentiometer overall resistance, as measured with the vehicle turned off.

In an advantageous variation, the fixed resistances of subcircuit 310, 320, 330 are replaced with digital potentiometers, which are digitally selectable resistances, e.g., having a 256-step scale. In such a variation, a digital memory or microcontroller stores different resistance selection values for the subcircuits and digital potentiometers used (numbering two or three, or even just one) and the vehicle models supported.

Public Notice Regarding the Scope of the Invention and Claims

The description above is largely directed to preferred exemplary embodiments of the invention. Specificity of language and statements of advantageous performance do not imply any commensurate limitation on the scope of the invention, nor do they require the stated performance. Portions of the application introducing structural and method elements of the various inventions should be understood as including broadening terminology such as "preferably," "in a variation," "in one embodiment" etc.

No one embodiment disclosed herein is essential to the practice of another unless indicated as such. Indeed, the invention, as supported by the disclosure above, includes all systems and methods that can be practiced from all suitable combinations of the various aspects disclosed, and all suitable combinations of the exemplary elements listed. Such combinations have particular advantages, including advantages not specifically recited herein.

Alterations and permutations of the preferred embodiments and methods will become apparent to those skilled in the art upon a reading of the specification and a study of the appendices and drawings. For example, different impedance-offsetting resistors can be employed for use with accelerator pedal sensors having resistance ranges significantly higher or lower than those used in the vehicles of TABLE I.

Accordingly, none of the disclosure of the preferred embodiments and methods defines or constrains the invention. Rather, the issued claims variously define the invention. Each variation of the invention is limited only by the recited limitations of its respective claim, and equivalents thereof, without limitation by other terms not present in the claim. For example, a claim reciting only a single resistor reads on claims to devices suitable for a single-sensor accelerator pedal as well as devices for accelerator pedals having two or three sensors, and using two or three parallel resistances. As a further example, a claim merely reciting a method act of connecting a resistance across a pair of electrical conductors reads on methods that include the use of connector structure for such connection and simple splicing of wires onto such conductors, e.g., with a crimping tool.

In addition, aspects of the invention are particularly pointed out in the claims using terminology that the inventor regards as having its broadest reasonable interpretation; the more specific interpretations of 35 U.S.C. § 112(6) are only intended in those instances where the terms "means" or "steps" are actually recited.

The words "comprising," "including," and "having" are intended as open-ended terminology, with the same meaning as if the phrase "at least" were appended after each instance thereof. A clause using the term "whereby" merely states the result of the limitations in any claim in which it may appear and does not set forth an additional limitation therein. Both in the claims and in the description above, the conjunction "or" between alternative elements means "and/or," and thus does not imply that the elements are mutually exclusive unless context or a specific statement indicates otherwise.

What is claimed is:

1. An accelerator pedal offset system for a motor vehicle, comprising:

(a) a first connector couplable to an electrical output of an accelerator pedal of a motor vehicle;

(b) a second connector couplable, in place of the electrical output of the accelerator pedal, to an engine control module of the vehicle, wherein the second connector is coupled to the first connector via a plurality of electrical conductors;

(c) a first resistor connected across a first pair of the electrical conductors; and (d) an electrically activated switch connected to selectably connect the first resistor across the first pair of electrical conductors.

2. The system of claim 1 further comprising a plurality of resistors, selectably connected in parallel with the first resistor, whereby a selectably variable resistance is connected across the first pair of electrical conductors.

3. The system of claim 2 wherein the plurality of resistors have values approximately in a doubling sequence.

4. The system of claim 1 further comprising a second resistor connected across a second pair of the electrical conductors.

5. The system of claim 4 further comprising two electrically activated switches separately connected between the first and second resistors and the first and second pairs of electrical conductors, respectively, whereby the first and second resistors are selectably connected across their respective pairs of the electrical conductors.

6. A method for increasing idle speed of an engine controlled by an accelerator pedal that is connected via a plurality of electrical conductors to a control module of a motor vehicle, comprising:

(a) connecting a first resistance across a first pair of the electrical conductors;

(b) wherein the first resistance has a value selected to increase the idle speed, when connected as in part (a), to about 1250 RPM with no activation of the accelerator pedal.

7. The method of claim 6 wherein the first resistance consists of a single resistor.

8. The method of claim 6 wherein the first resistance value is in the range of about 45–95 kilohms.

9. The method of claim 6 wherein the first resistance includes a first resistor and a plurality of resistors, selectably connected in parallel with the first resistor, whereby a selectably variable resistance is connected across the first pair of electrical conductors.

10. The method of claim 9 wherein the selectably variable resistance is in the range of about 40–100 kilohms.

11. The method of claim 6 further comprising connecting a second resistance across a second pair of the electrical conductors.

12. The method of claim 11 wherein the second resistance value is in the range of about 21–45 kilohms.

13. The method of claim 11 further comprising connecting a third resistance value having a value in the range of about 75–133 kilohms across a third pair of the electrical conductors.

14. A method of retrofitting a motor vehicle having an accelerator pedal that is connected via a plug-type connector and a cable having a plurality of electrical conductors to a control module of a motor vehicle, comprising:

(a) providing a module containing:

(1) a first connector couplable to an electrical output of an accelerator pedal of a motor vehicle;

(2) a second connector couplable, in place of the electrical output of the accelerator pedal, to an engine control module of the vehicle, wherein the second connector is coupled to the first connector via a plurality of electrical conductors;

(3) a first resistor connected across a first pair of the electrical conductors; and (4) an electrically activated switch connected to selectably connect the first resistor across the first pair of electrical conductors;

(b) disconnecting the cable from the control module;

(c) connecting the cable to the first connector; and (d) connecting the second connector to the control module.

15. The method of claim 14 further comprising activating the switch.

16. The method of claim 14 wherein the provided module further contains a plurality of resistors, selectably connected in parallel with the first resistor, whereby a selectably variable resistance is connected across the first pair of electrical conductors.

17. The method of claim 16 wherein the selectably variable resistance is in the range of about 40–100 kilohms.

18. The method of claim 14 wherein the provided module further contains a second resistor having a value in the range of about 21–45 kilohms connected across a second pair of the electrical conductors.

19. The method of claim 18 wherein the provided module further contains two electrically activated switches separately connected between the first and second resistors and the first and second pairs of electrical conductors, respectively, whereby the first and second resistors are selectably connected across their respective pairs of the electrical conductors.

20. The method of claim 18 further comprising connecting a third resistor having a value in the range of about 75–133 kilohms across a third pair of the electrical conductors.

* * * * *